US006191347B1

(12) United States Patent
Hoshino

(10) Patent No.: US 6,191,347 B1
(45) Date of Patent: Feb. 20, 2001

(54) STRAP CLIP FOR MUSICAL INSTRUMENT

(75) Inventor: Yoshihiro Hoshino, Nagoya (JP)

(73) Assignee: Hoshino Gakki Co., Ltd. (JP)

( * ) Notice: Under 35 U.S.C. 154(b), the term of this patent shall be extended for 0 days.

(21) Appl. No.: 09/518,055

(22) Filed: Mar. 2, 2000

(30) Foreign Application Priority Data

Oct. 27, 1999 (JP) ..... 11-305677

(51) Int. Cl.[7] ..... G10D 3/00
(52) U.S. Cl. ..... 84/329; 84/327; 84/453
(58) Field of Search ..... 84/329, 327, 453; 248/74.5, 222.52

(56) References Cited

U.S. PATENT DOCUMENTS 4,279,396 * 7/1981 Bendock ..... 248/206 R
4,897,898 * 2/1990 Chapin ..... 24/3 J

* cited by examiner

*Primary Examiner*—Robert E. Nappi
*Assistant Examiner*—Shih-yung Hsieh
(74) *Attorney, Agent, or Firm*—Ostrolenk, Faber, Gerb & Soffen, LLP

(57) ABSTRACT

A strap clip useful for example for attaching a strap to the body of a musical instrument. The strap is U-shaped and includes an installation seat screwed to the body of the instrument, an upstanding strap hook part and an insertion part for being inserted into a cut in the strap. The cut in the strap is elongated along the strap and also has a wider region where the hook part of the clip is received. The insertion part is wider than the hook part, so that the insertion part holds the hook part of the U-shaped clip in the cut in the strap. The tip of the insertion part is bent downward toward the installation seat.

14 Claims, 8 Drawing Sheets

(A)

(B)

(C)

STRAP CLIP FOR MUSICAL INSTRUMENT

BACKGROUND OF THE INVENTION

This invention relates to a strap clip for a musical instrument for installing a strap, e.g., a shoulder strap, on such a musical instrument as a guitar, etc.

DESCRIPTION OF A PRIOR ART EMBODIMENT

This embodiment is described with reference to FIGS. 7 and 8. Strap S is made of either leather or cloth and is used for supporting a musical instrument G on a musician's shoulder for playing. The strap is installed on the main body Ga of a musical instrument G, such as a guitar, etc. as shown in FIG. 7. At both end regions, the strap S has a cut Sa through it, including an enlarged opening Sb. The strap S is freely detachably installed on the musical instrument Ga on a respective protuberant button or member 50 for strap installation (called a strap pin or a strap button, etc.). Those buttons 50 are fastened at two required locations on the musical instrument Ga. Each button is inserted into and engages in its cut Sa in the strap.

In the past, it has been customary for the protuberant member 50 to be formed approximately in the shape of an inverted cone, wherein the outer diameter at the top 52 is greater than the outer diameter at the base 51 (toward the musical instrument) or alternatively approximately in a columnar shape, with a jaw formed at its top (this version not being shown in the drawing).

Irrespective of the shape or profile of the protuberant member 50, the outer diameter at its base is formed approximately equal to the diameter of the opening Sb of the cut Sa of the strap 5, with the base 51 of the protuberant member 50 and the opening Sb of the cut Sa to be engaged subsequent to insertion of the protuberant member 50 into the cut Sa in the strap S.

An installation screw 53 fastens the protuberant member 50 on the instrument Ga. An elastic washer of felt, etc. is interposed between the instrument Ga and the protuberant member 50 for protecting the musical instrument Ga from damage.

Where a strap S is installed on the musical instrument Ga by a protuberant member 50 as described above, however, it is easy to engage the strap S with the protuberant member 50. But there is a problem that the strap S may be dislodged from the protuberant member 50, depending upon the posture of the performer during a performance. Specifically, in the vicinity of the cut Sa, the strap S is deformed in direction Z, which is the direction of the installation axis of the protuberant member 50 which crosses the strap installation surface at a right angle. The cut Sa is "rolled", for instance, and the strap S is easily dislocated from the protuberant member 50.

In the conventional product, moreover, the cut Sa of the strap S gradually expands due to repeated attachment and detachment of the strap S on the instrument Ga. This deteriorates the engagement between the cut Sa and the protuberant member 50, and eventually makes it impossible to install the strap S on the musical instrument, necessitating frequent replacement of the strap.

A strap installation structure with a lock system has recently been proposed wherein the strap and the protuberant member are fixed by bolts and nuts, for solving the previously described problem. However, that complicates the structure as the number of parts involved increases, so that it takes a longer time for installation and manufacturing cost rises.

Further, the strap installation lock system firmly engages the strap and the protuberant member, making it difficult for the strap to be disengaged from the protuberant member. If the performer moves rapidly with the instrument, a huge burden is placed on the linking part of the strap, causing mutilation of the strap in some cases.

SUMMARY OF THE INVENTION

An object of the invention is to overcome the above described problems. The invention provides a strap clip primarily useful for a musical instrument, but useful for other applications where a strap is attached to a body or to a surface which enables smooth installation of a strap on the musical instrument, by a simple construction and with few parts involved. Subsequent to installation, moreover, it is difficult for the strap to be disengaged from the instrument or other body, and satisfactory engagement with the strap is maintained for a long period of time. Further, it eliminates inconveniences, such as a cut-off of the strap, due to fast movement of the performer.

The invention relates to a strap clip for musical instrument or other body which is installed on the musical instrument or body and is inserted into a cut in a strap. The clip comprises an installation seat having an installation hole to be screwed to the musical instrument or body, a narrow width bent up hook which is integral with the rear part of the installation seat, and an insertion part which is integrally folded back over the top of the installation seat from the bent hook and is wide at its center region but tapers toward its tip. The tapered tip is also adapted, e.g., bent down, to approach the installation seat.

The strap clip further includes an insertion window in the wide center region of the insertion part for permitting passage of an installation screw. The window is positioned above the screw installation hole of the installation seat.

In addition, the strap clip may be freely rotated with respect to the musical instrument or body.

Other objects and features of the invention are explained below with reference to the attached drawings.

DESCRIPTION OF A PREFERRED EMBODIMENT

Figure 1:
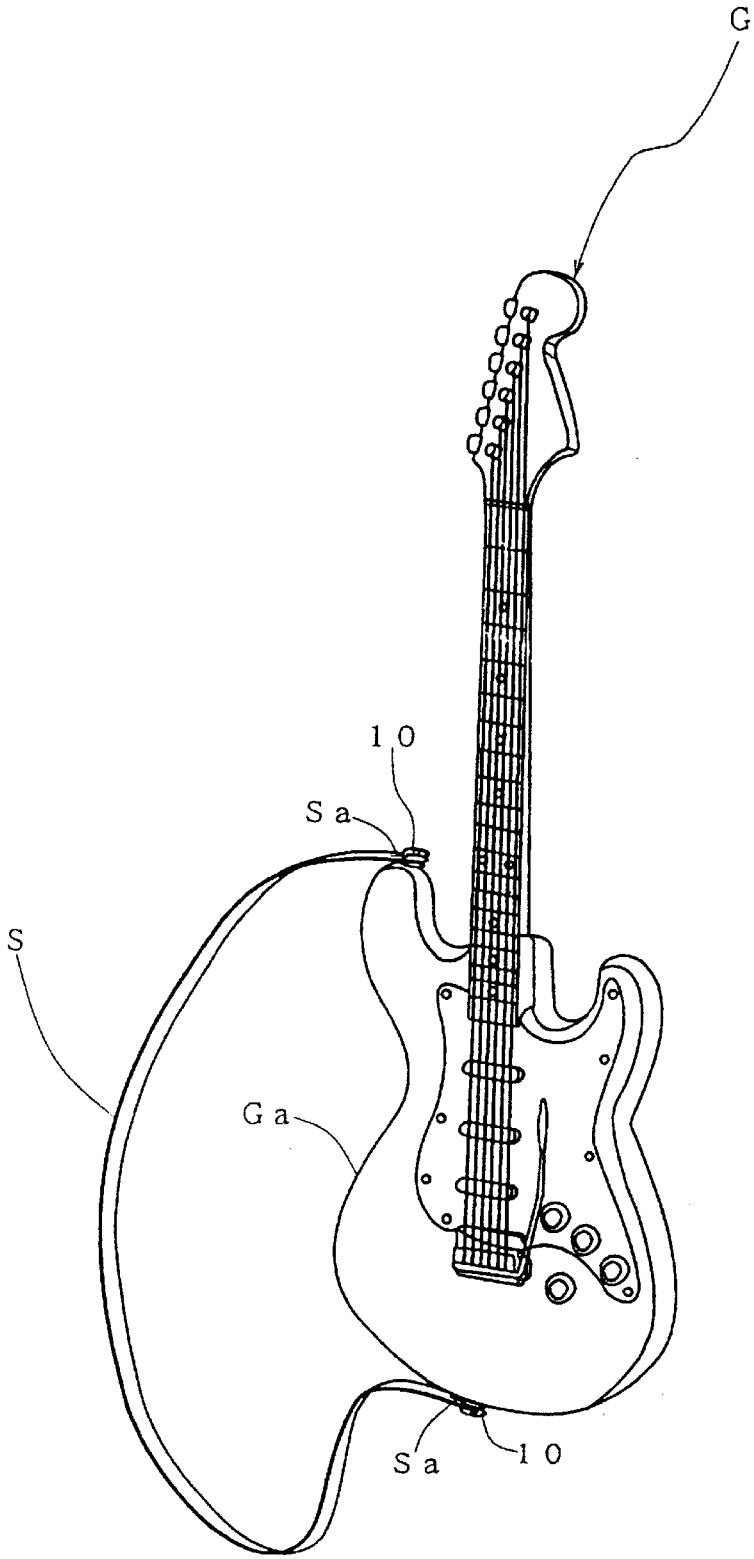
FIG. 1 is an oblique view of an entire musical instrument on which the strap clip according to the invention is employed.
Figure 2:
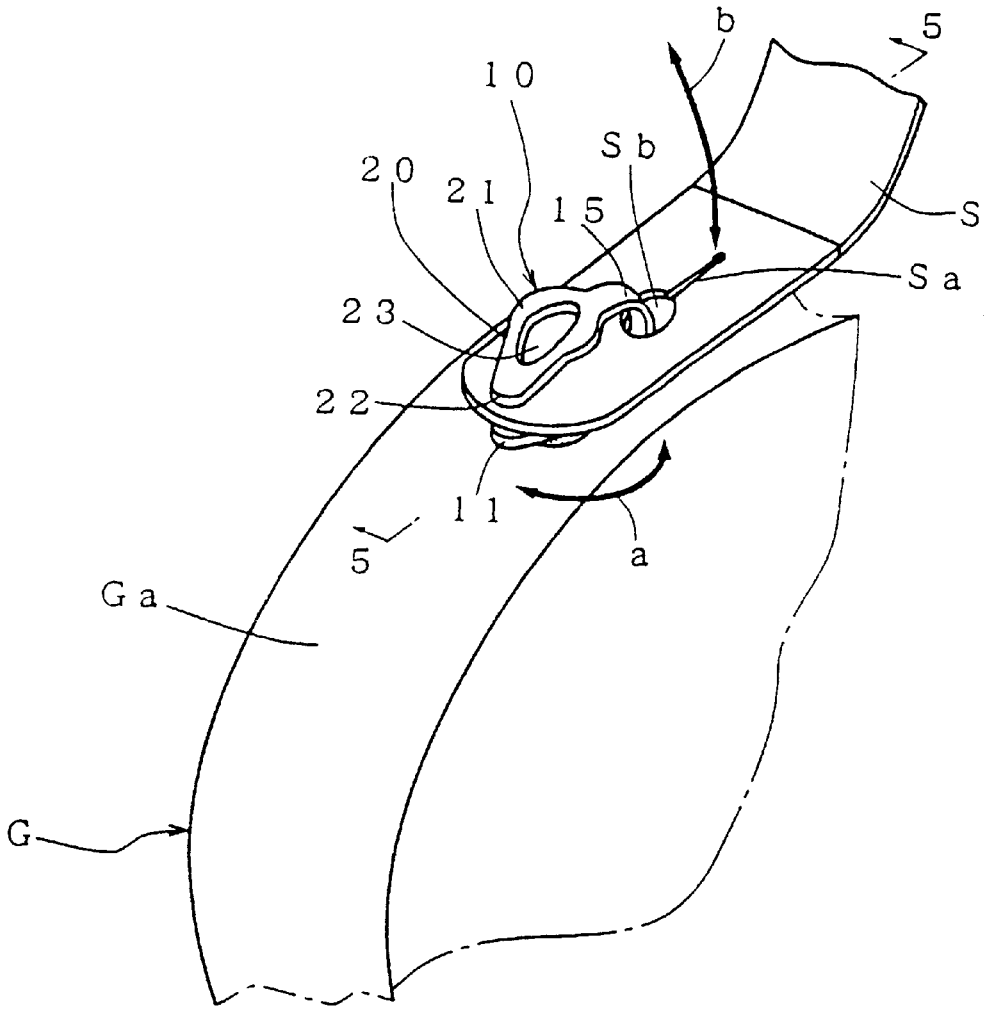
FIG. 2 is a partial and oblique view showing the essential part of the musical instrument with strap clip.

A musical instrument G, which is a guitar in the example in FIGS. 1 and 2, or another body, has a strap S installed on the musical instrument Ga. As explained above, the strap S makes it possible for the performer to play the musical instrument by hanging the strap on the shoulder. The strap is typically made of either leather or cloth, etc.

In addition, the strap S has a respective cut Sa at the regions near both of ends of the strap. Each cut Sa contains an opening Sb. The strap S is freely detachably installed on the musical instrument Ga. Through engagement of a strap clip 10 for a musical instrument according to an embodiment of this invention at two required locations on the musical instrument Ga at the cuts Sa.

Figure 3:
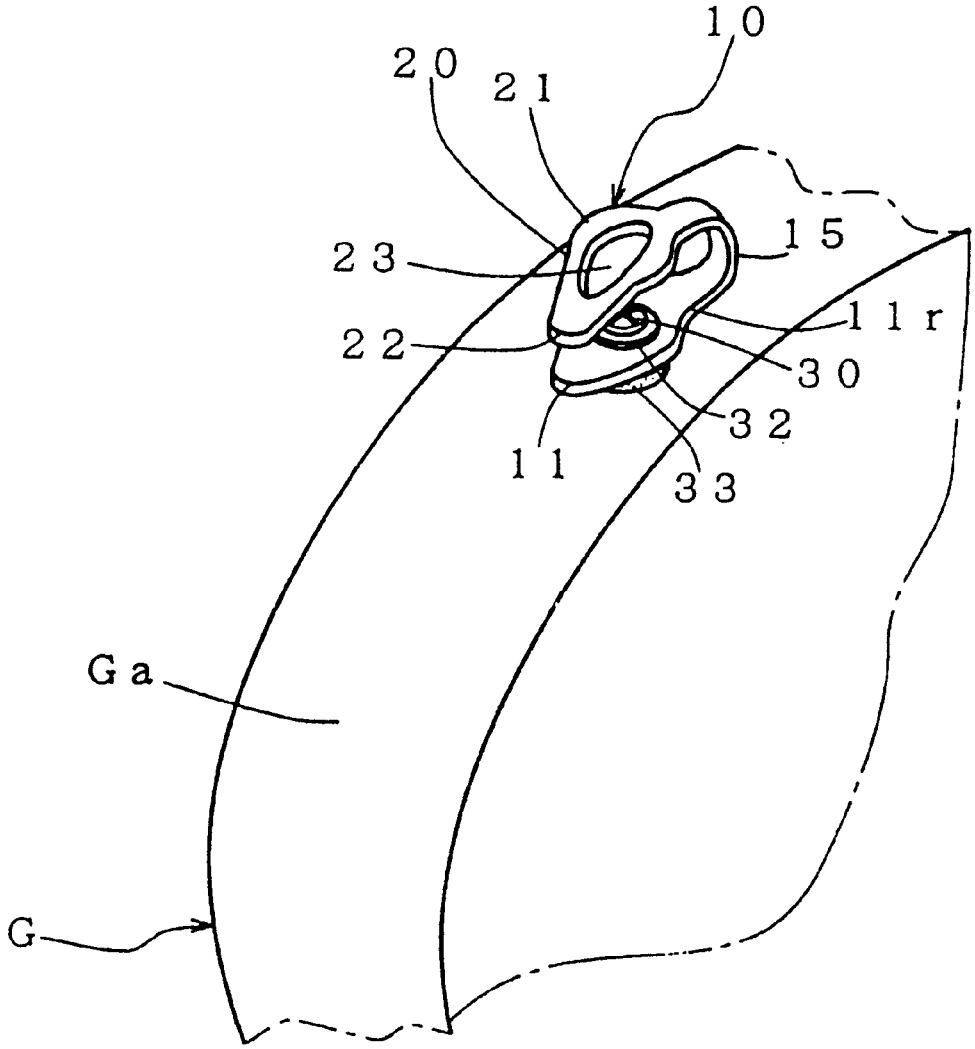
FIG. 3 is a partial and oblique view showing the invention with the strap separated from the musical instrument.
Figure 4:
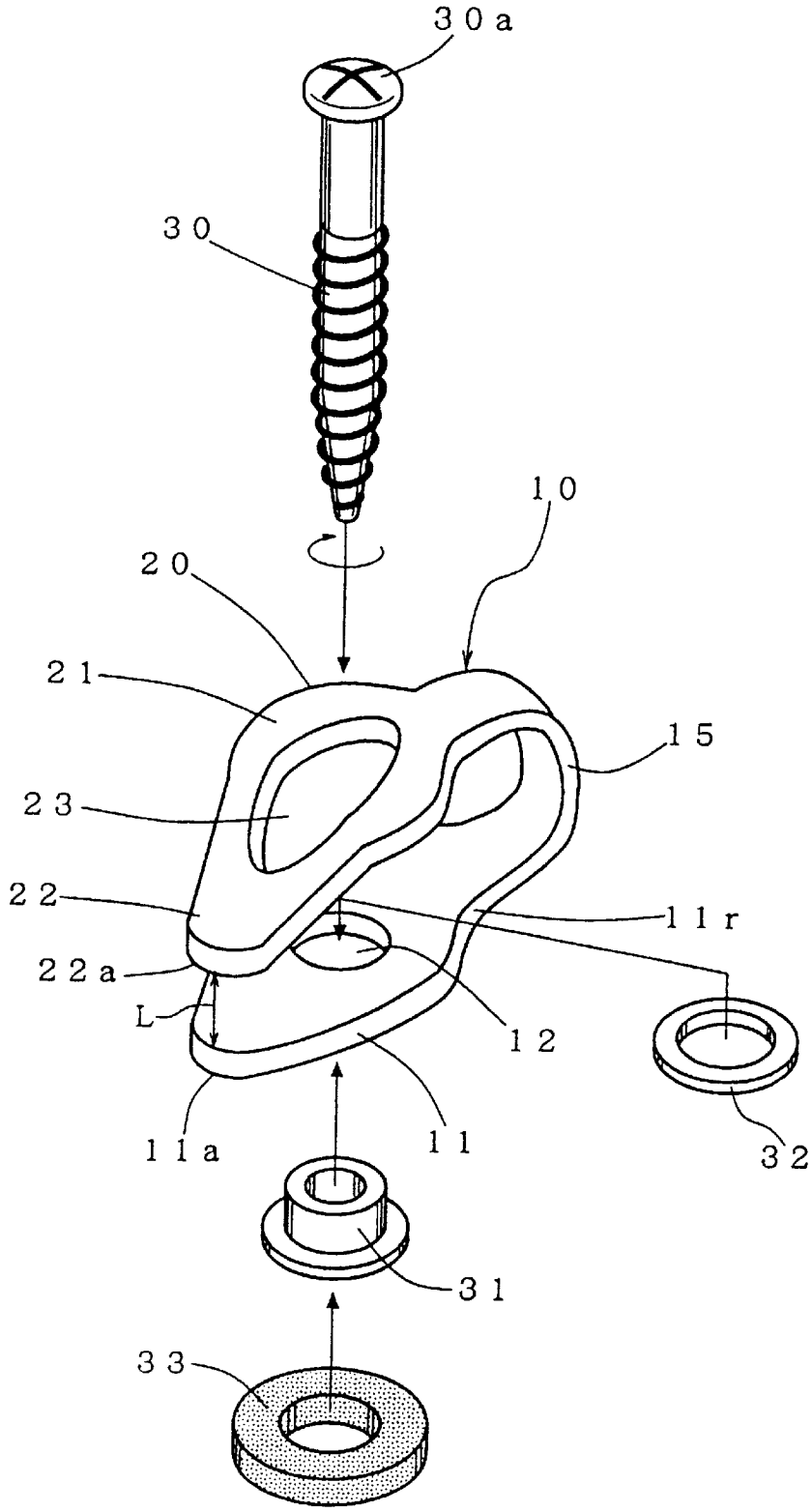
FIG. 4 is an oblique view showing the strap clip and its installation elements.

The strap clip 10 includes a clip body which is secured to the musical instrument Ga. The clip is inserted through the cut Sa of the strap S. FIGS. 3 and 4 show that the clip comprises an installation seat 11, a bent upwardly extending engagement part 15 and an insertion part 20 so that the clip has a generally U-shape. The strap clip 10 may be comprised of a synthetic resin having flexibility, such as polypropylene, etc.

The insertion part 20 may be expanded relative to the installation seat 11 when the insertion part 20 is inserted into the cut Sa of the strap S, as described below, thereby securely installing the strap S.

A strap clip 10 formed from a synthetic resin, as described above, is easier to work on. Also, the strap clip 10 serves as a shock absorber when the musical instrument is placed against a wall, etc. or when the musical instrument is placed on the floor, thereby preventing the floor from being damaged or the strap clip 10 from digging into the musical instrument Ga. However, the strap clip 10 may be made of wood, metal or some other material.

The installation seat 11 is used for installing the strap clip 10 on the musical instrument Ga. The seat extends approximately horizontally, i.e., parallel to the surface of the instrument on which the seat is installed. The seat has a screw installation hole 12 for attachment to the main musical instrument Ga.

The bent hook part 15 joins the installation seat 11 and the insertion part 20. The hook part also extends through and is hooked in the cut Sa of the strap S. The hook part is integrally formed bent approximately in the shape of a U and extends in upward from the rear part 11*r* of the installation seat 11. It is narrower than the width S of the installation seat 11 and of the insertion part 20.

The insertion part 20 is to be inserted through the cut Sa in the strap S. The part 20 is integrally formed with and bent back from the bent hook part 15 toward the top of the installation seat 11. The insertion part 20 has a wide central part 21 and the width of the insertion part gradually narrows toward a tapered tip 22. The plane shape of the insertion part 20 is approximately that of an arrowhead (or an oval shape with the longitudinal direction being the longer diameter and the width direction being the shorter diameter).

The insertion part 20 shaped as described, may be installed more smoothly relative to the strap clip 10, but the strap S also is more difficult to dislocate after the installation.

Moreover, the tapered tip 22 of the insertion part 20 is slightly bent down to approach the installation seat 11 between the end 22*a* of the tapered tip 22 and the end 11*a* of the installation seat 11. The approach of the tapered tip 22 at the tip 20 toward the installation seat 11 makes it difficult for the strap S to dislocate or separate from the strap clip 10. The distance L between the end 22*a* of the tapered tip 22 and the end 11*a* of the installation seat 11 is suitably determined in consideration of the material quality (flexibility) of the strap clip 10, the thickness of the strap S, etc.

An insertion window 23 for the installation screw 30 formed at a position in the wide part 21 of the insertion part 20 above the screw installation hole 12 in the installation seat 11, so that the insertion part 20 does not obstruct insertion of the screw 30, and strap clip 10 may be quite easily secured to the main musical instrument Ga.

Figure 5:
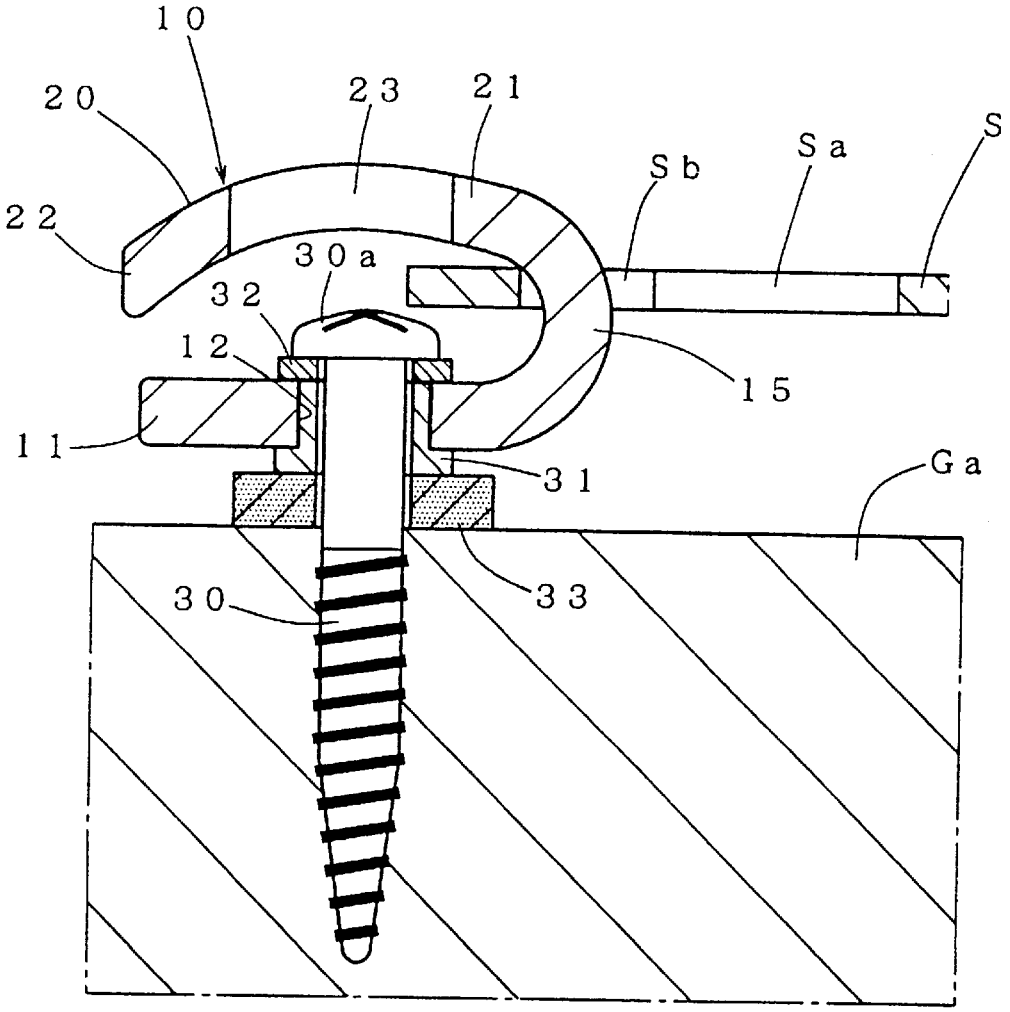
FIG. 5 is a cross-section cut along line 5—5 in FIG. 2.

Installation of the strap clip 10 on the musical instrument Ga is described with reference to FIGS. 4 and 5. The strap clip 10 is installed to be freely rotatable relative to the musical instrument Ga by the installation screw 30 that is inserted into a bush 31. The bush 31 is arranged inside the screw installation hole 12 of the installation seat 11. The installation screw 30 is inserted through the insertion window 23 of the insertion part 20 and is screwed to the main musical instrument Ga, with a washer 32 on the seat 11. If an installation screw 30 without a screw thread on the side of its head 30*a* is used like the installation screw 30 shown in the drawing,the strap clip 10 can be installed freely rotatably on the main musical instrument Ga even if the bush 31 is omitted.

Figure 6:
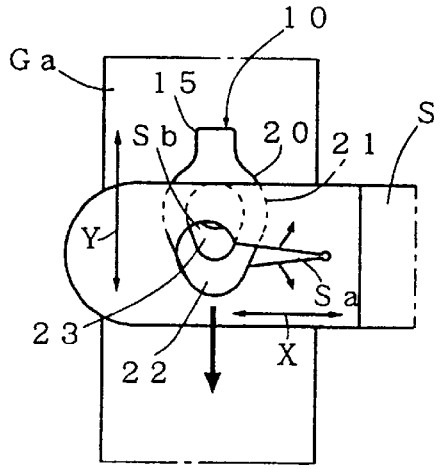
FIGS. 6A, B and C show an example of a procedure for installing a strap on the musical instrument.
Figure 6:
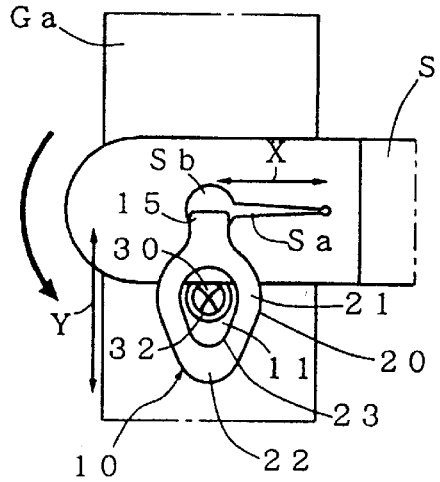
Figure 6:
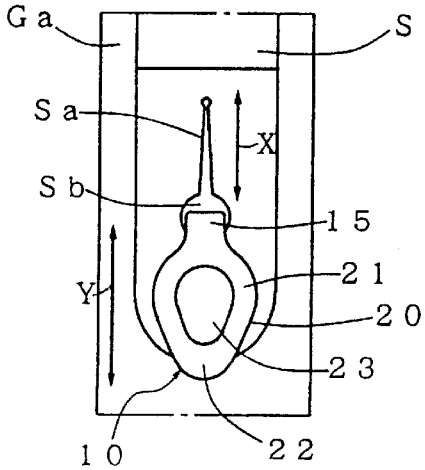

If the strap clip 10 is installed freely rotatably on the musical instrument Ga, the strap S can rotate along with the strap clip 10 during a musical performance, as the player rotates or swings the musical instrument G on his shoulder by the strap S. The strap S is hooked to the strap clip 10 such that the longitudinal direction X of the cut Sa of the strap S and the longitudinal direction Y of the clip 10 may become parallel with each other, as shown in FIG. 6C, described below. The invention makes it possible to prevent the strap from rotating in a direction where the strap is dislocated relative to the strap clip 10 (i.e., the direction in which the longitudinal direction X of the cut Sa of the strap S and the longitudinal direction Y of the clip cross each other at a right angle). This makes it more difficult for the strap S to be disengaged from the strap clip 10. As the strap S moves, moreover, the strap clip 10 smoothly rotates along with the strap S, making it possible to reduce the friction or the burden on the strap S due to that movement, thereby eliminating such an inconvenience as breaking of the strap S.

In addition, the strap clip 10 and its installation require a small number of parts involved in an extremely simple construction, markedly reducing the manufacturing cost.

During installation of the strap clip 10, an elastic gasket 33, e.g., of felt, etc. is interposed between the strap clip 10 and the musical instrument Ga. This makes it possible to prevent the musical instrument Ga from being damaged due to installation of the strap clip 10 on the musical instrument Ga.

An example of the procedure for installing the strap S on the musical instrument Ga using the strap clip 10 for the musical instrument is now described. As shown in FIG. 6A, the insertion part 20 of the strap clip 10 is inserted into the cut Sa of the strap S leading with the tapered tip. As shown in FIG. 6B, the bent hook part 15 is positioned inside the widened opening Sb of the cut Sa, so that the strap S is held between the installation seat 11 and the insertion part 20 and the widened part 21 of the insertion part 20 prevents the insertion part from exiting back through the cut Sa.

If the insertion part 20 is inserted into the cut Sa of the strap S when the longitudinal direction X of the cut Sa of the strap S and the longitudinal direction Y of the strap clip 10 cross each other, e.g., at a right angle, as is shown in the drawing, the insertion is done smoothly. At the same time, it will not be necessary to expand the cut Sa to such an extent as in the prior art embodiment where the protuberant member 50 is inserted into the cut Sa of the strap S as explained above. Use of the invention makes it possible to prevent gradual expansion of the cut Sa by repeated attachment and detachment of the strap S, as in the past.

After its installation, the strap S is rotated relative to the strap clip 10 so that the longitudinal direction X of the cut Sa of the strap S and the longitudinal direction Y of the strap clip 10 are oriented parallel, as shown in FIG. 6C, and the opening Sb of the cut Sa of the strap S is hooked to the bent hook part 15 of the strap clip 10. As a result, the strap S is easily installed on the musical instrument Ga.

Figure 7:
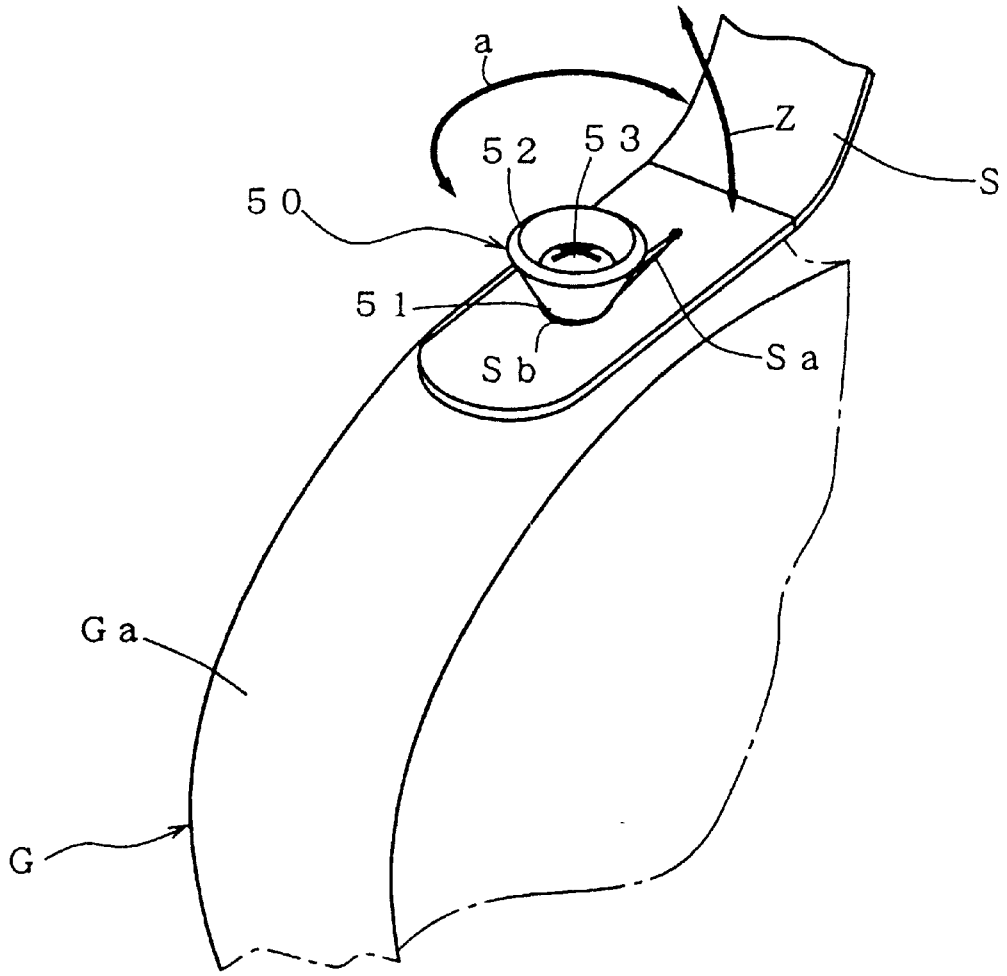
Fig. 7 PRIOR ART
FIG. 7 is a partially oblique view of a musical instrument showing a prior art installation structure for a strap on a musical instrument.
Figure 8:
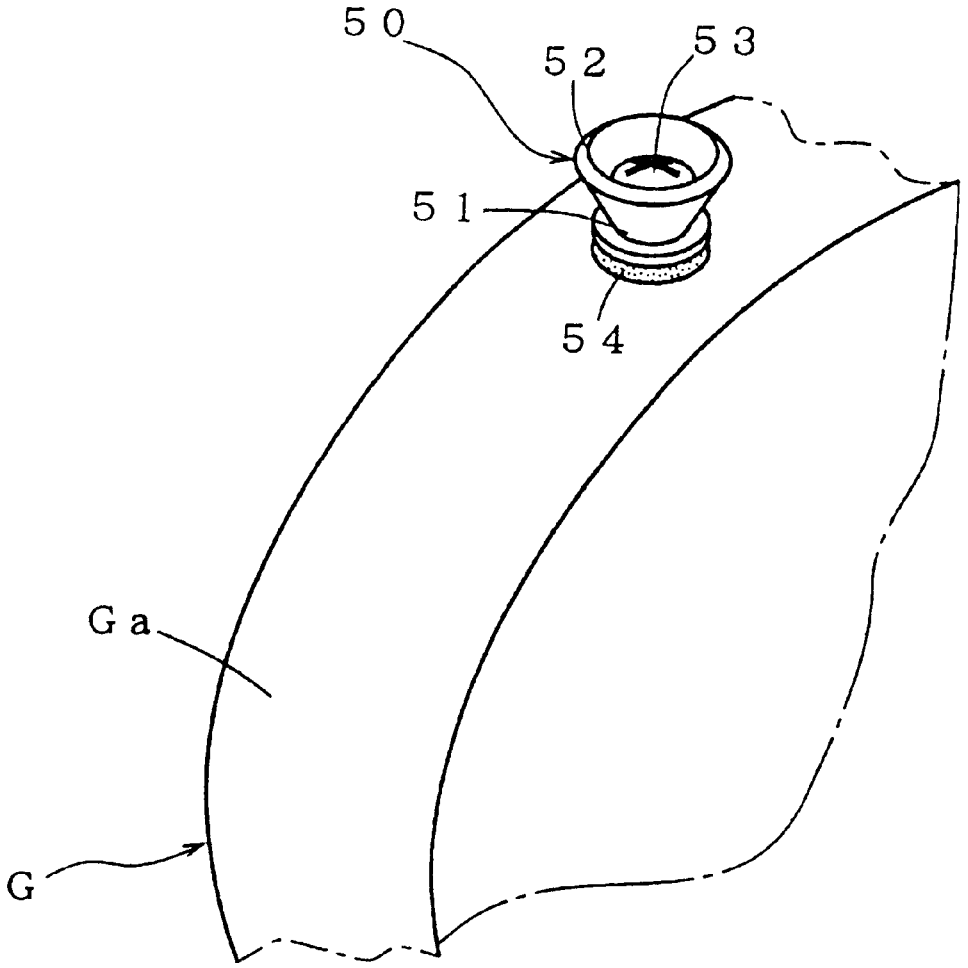
Fig. 8 PRIOR ART
FIG. 8 is a partially oblique view of the musical instrument showing the state in which its strap has been removed.

As the strap S is installed on the musical instrument Ga in this manner, movement, e.g., deformation of the strap S is permitted in the direction which crosses the direction of the installation surface at a right angle (in the direction of the installation axis of the strap clip 10). In other words, if the strap S is installed on a conventional protuberant member 50, as shown in FIGS. 7 and 8, the degree of freedom of the strap S relative to the protuberant member 50 is only for rotation in the path of arrow a in the direction of the installation surface of the strap S. However, when the strap S is installed using the strap clip 10 of the invention, the degree of freedom of the strap S relative to the strap clip 10 permits rotation on path a in the direction of the installation surface of the strap S and in the direction which crosses the direction of the installation surface of the strap S at a right angle. As a consequence, the strap S will not separate from the strap clip 10, when the cut Sa is "rolled", irrespective of the state of the performance, thereby enabling smooth movement and reducing the friction and burden placed on the strap S.

The strap S can be easily dismantled by rotating the strap S relative to the strap clip 10 such that the longitudinal direction X of the cut Sa of the strap S and the longitudinal direction Y of the strap clip 10 may cross each other at a right angle as is shown in FIG. 6B, followed by withdrawal of the insertion part 20 of the strap clip 10 from the cut Sa of the strap S.

The strap clip for a musical instrument comprised of an installation seat, a bent hook part and an insertion part according to the invention enables smooth installation of the strap on the musical instrument, and the strap is difficult to dislocate once it has been installed. If the strap is installed on the main musical instrument by using this strap clip, in particular, it is easy to prevent rolling of the cut part of the strap, even when the strap is deformed in a direction which crosses the direction of the installation surface thereof at a right angle.

In addition, the degree of the expansion of the cut in the strap when the strap is to be hooked to the strap clip can be smaller than in the conventional attachment. This makes it possible to prevent gradual expansion of the cut caused by repeated attachment and detachment of the strap, thereby making it possible to maintain satisfactory engagement between the strap clip and the strap for a long period of time.

When the strap is installed by using the strap clip, moreover, the number of the parts required is small and the resultant structure is extremely simple, markedly reducing the manufacturing cost.

An insertion window for the installation screw located in the insertion part above the screw installation hole of the installation seat of the strap clip will provide a better installation capability on the main musical instrument.

If the strap clip for a musical instrument is installed freely rotatable relative to the main musical instrument, the strap rotates along with the strap clip when the performer rotates or swings the instrument on his shoulder using the strap. This prevents any possible rotation of the strap relative to the strap clip in the direction in which the strap will be dislocated, making it more difficult for the strap to be separated from the strap clip. As the strap clip rotates smoothly in response to the movement of the strap, moreover, any possible friction or burden placed on the strap can be reduced.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A strap clip for installing a strap on an object, wherein the strap includes a cut in the strap, the clip comprising:

an installation seat including a fixture for fastening the installation seat to the object;

a narrow width hook part bent up from the installation seat extending away from the object and the hook part being shaped for passing through and for being retained in the cut of the strap;

an insertion part attached to and generally folded over from the hook part and being spaced above the installation seat, the insertion part including a wide region toward the hook part and a tip tapering forward from the wide region away from the hook part, wherein the insertion part is configured to pass through the cut in the strap and the hook part is retained in the cut in the strap by the wide region of the insertion part.

2. The strap clip of claim 1, wherein the tip of the insertion part is inclined generally in the direction toward the installation seat.

3. The strap clip of claim 2, wherein the clip generally has a U-shape defined by the installation seat, the hook part and the insertion part.

4. The strap clip of claim 3, wherein the installation seat and the insertion part both have rear parts and the hook part joins the rear parts thereof.

5. The strap clip according to claim 2, wherein the strap having two spaced apart strap regions therealong and a respective cut being formed in each of the strap regions; the clip being affixed to the object, each clip for receiving the strap at a respective one of the cuts in the strap.

6. The strap clip of claim 2, wherein the strap being attached to the clip by the hook part of the clip being retained in the cut in the strap between the installation seat and the insertion part.

7. The strap clip of claim 6, wherein the cut in the strap is formed to extend in the direction along the strap a distance greater than the width of the hook part and greater than the width of the wide region of the insertion part, for enabling the wide region of the insertion part to be inserted through the cut.

8. The strap clip of claim 6, wherein the cut includes a wider region of the cut toward an end thereof, the wider region of the cut having a width approximating the width of the hook part and shaped so as to permit the strap to rotate around the hook part of the clip while the hook part extends through the wider region of the cut in the strap.

9. The strap clip of claim 1, wherein the fixture in the installation seat comprises an installation hole for receiving an attachment element for attaching the installation seat to the object.

10. The strap clip of claim 9, further comprising an attachment element comprising a screw for being screwed into the object after passing through the installation hole.

11. The strap clip of claim 10, further comprising an installation window for passage of the installation screw and formed in the insertion part above the installation hole in the wide region of the insertion part.

12. The strap clip of claim 9, further comprising an installation window for passage of the attachment element and formed in the insertion part above the installation hole in the wide region of the insertion part.

13. The strap clip of claim 1, wherein the clip is attached to the object at the fixture to be freely rotatable with respect to the object.

14. The strap clip of claim 1, wherein the object comprises the body of a musical instrument.

* * * * *